US007023317B1

(12) United States Patent
Herbert

(10) Patent No.: US 7,023,317 B1
(45) Date of Patent: Apr. 4, 2006

(54) CELLULAR TRANSFORMERS

(76) Inventor: Edward Herbert, 1 Dyer Cemetery Rd., Canton, CT (US) 06019-2029

( * ) Notice: Subject to any disclaimer, the term of this patent is extended or adjusted under 35 U.S.C. 154(b) by 160 days.

(21) Appl. No.: 10/708,846

(22) Filed: Mar. 27, 2004

Related U.S. Application Data

(60) Provisional application No. 60/460,333, filed on Apr. 3, 2003.

(51) Int. Cl.
*H01F 27/30* (2006.01)

(52) U.S. Cl. ..... 336/205; 336/182; 336/175

(58) Field of Classification Search ..... 336/182, 336/183, 205, 207, 185, 175
See application file for complete search history.

(56) References Cited

U.S. PATENT DOCUMENTS 3,783,415 A * 1/1974 Koskinen ..... 333/25
4,259,107 A * 3/1981 Guay ..... 423/29
4,656,451 A * 4/1987 Pomponio ..... 336/96
5,392,017 A * 2/1995 Oter Munoz et al. ..... 336/83
5,504,469 A * 4/1996 McGrane ..... 336/206
5,548,255 A * 8/1996 Spielman ..... 333/132
6,215,386 B1 * 4/2001 Gokita et al. ..... 336/182
6,476,326 B1 * 11/2002 Fuzier et al. ..... 174/95
2004/0113736 A1 * 6/2004 Schimel ..... 336/174

* cited by examiner

*Primary Examiner*—Anh Mai

(57) ABSTRACT

The winding of matrix transformers having multiple turn primary windings is made much easier, and the resulting transformer is much more consistent, if a "cellular" insert having a plurality of through holes is placed through each trough hole of the matrix transformer. Preferably, there is one hole in the cellular insert for each wire, though two or more wires can be placed in each hole. In one embodiment, insulating cellular inserts are placed through the entire length of the cellular transformer to guide and locate the primary windings. In another embodiment, each element of the cellular transformer has cellular inserts, and the elements are coupled together. In another embodiment, the cellular insert is a conductor and is part of the secondary circuit.

6 Claims, 4 Drawing Sheets

CELLULAR TRANSFORMERS

CROSS REFERENCE TO RELATED APPLICATIONS

This is a continuation in part of a provisional application of the same name, Ser. No. 60/460,333 filed 3 Apr., 2003. Priority to that date is claimed.

BACKGROUND OF INVENTION

This invention relates to matrix transformers, and in particular to matrix transformers having multiple turn primaries, either single coil windings as for a full bridge, half bridge or forward converter or multiple coil windings as for push-pull windings, split windings or a forward converter having a reset winding.

FIG. 1 shows a prior art magnetic core 1 as may be used to make a matrix transformer. FIG. 2 shows a phantom view 4 of the magnetic core 1 of FIG. 1 further comprising first and second secondary windings 2 and 3. FIG. 3 shows a prior are "element" 5 of a matrix transformer comprising a pair of magnetic cores 1, 1 which are the magnetic core 1 of FIG. 1 each further comprising first and second secondary windings 2 and 3. The secondary windings 2 and 3 may be connected in various arrangements as required by a particular application.

FIG. 4 shows a prior art matrix transformer 10 comprising five magnetic elements 5—5 which are the magnetic element 5 of FIG. 3. A primary winding 11 is wound by hand through the five elements 5—5 of the matrix transformer 10. Winding the primary winding 11 is a labor intensive manual operation. It is time consuming and requires considerable skill, yet the result is often messy. If the wires of the primary winding 11 cross in the matrix transformer 10, it can be difficult or impossible to get the required number of turns, and their arrangement is some-what random yielding inconsistent product.

SUMMARY OF INVENTION

The winding of matrix transformers having multiple turn primary windings is made much easier, and the resulting transformer is much more consistent, if a "cellular" insert having a plurality of through holes is placed through each trough hole of the matrix transformer. Preferably, there is one hole in the cellular insert for each wire, though two or more wires can be placed in each hole. In one embodiment, insulating cellular inserts are placed through the entire length of the cellular transformer to guide and locate the primary windings. In another embodiment, each element of the cellular transformer has cellular inserts, and the elements are coupled together. In another embodiment, the cellular insert is a conductor and is part of the secondary circuit.

DETAILED DESCRIPTION

Figure 1:
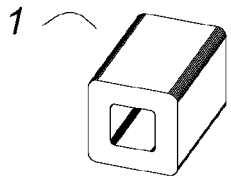
Fig. 1 Prior Art
FIG. 1 shows a prior art magnetic core.
Figure 2:
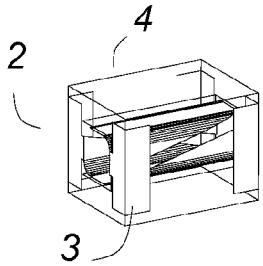
Fig. 2 Prior Art
FIG. 2 shows the core of FIG. 1 in phantom and shows two prior art secondary windings installed therein.
Figure 3:
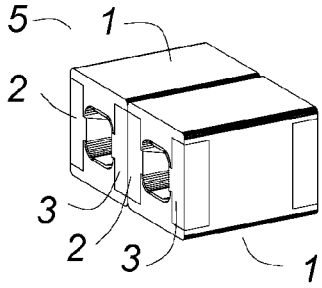
Fig. 3 Prior Art
FIG. 3 shows a prior art matrix transformer "element".

FIG. 1 shows a prior art magnetic core 1 as may be used to make a matrix transformer. Note in particular that the magnetic core 1 does not have a gap, it is one solid piece. Because of that, the core is not assembled around a winding as in a conventional transformer. The winding has to be inserted through the center hole of the magnetic core 1. FIG. 2 shows the magnetic core 1 of FIG. 1 as a phantom core 4, with prior art first and second secondary windings 2 and 3. FIG. 3 shows a prior are "element" 5 of a matrix transformer comprising a pair of magnetic cores 1, 1 which are the magnetic core 1 of FIG. 1 each further comprising first and second secondary windings 2 and 3. The secondary windings 2 and 3 may be connected in various arrangements as required by a particular application. As examples, not limitations, they may be connected in series for higher voltage or as a "half turn" winding for lower voltage, higher current applications.

Figure 4:
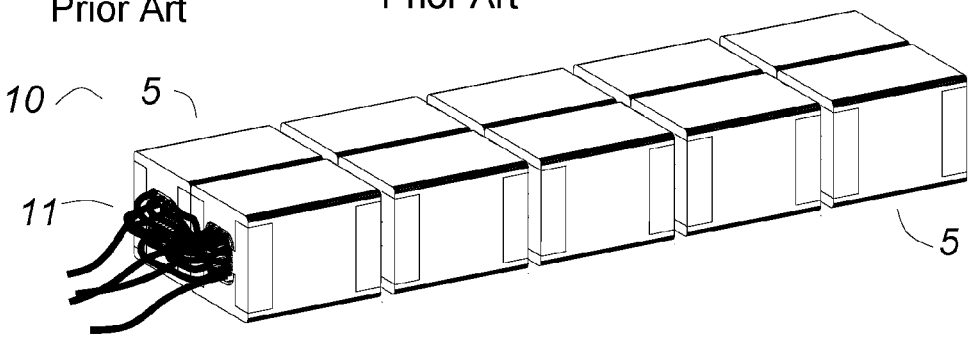
Fig. 4 Prior Art
FIG. 4 shows a prior art matrix transformer with a wound primary winding.

FIG. 4 shows a prior art matrix transformer 10 comprising five magnetic elements 5—5 that are the magnetic element 5 of FIG. 3. Because the magnetic cores of the elements 5—5 are solid one piece cores, the winding must be inserted through the center holes of the elements 5—5. A primary winding 11 is wound by hand through the five elements 5—5 of the matrix transformer 10. Winding the primary winding 11 is a labor intensive manual operation. It is time consuming and requires considerable skill, yet the result is often messy. If the wires of the primary winding 11 cross inside of the matrix transformer 10, it can be difficult or impossible to get the required number of turns, and their arrangement is somewhat random yielding inconsistent product.

Figure 5:
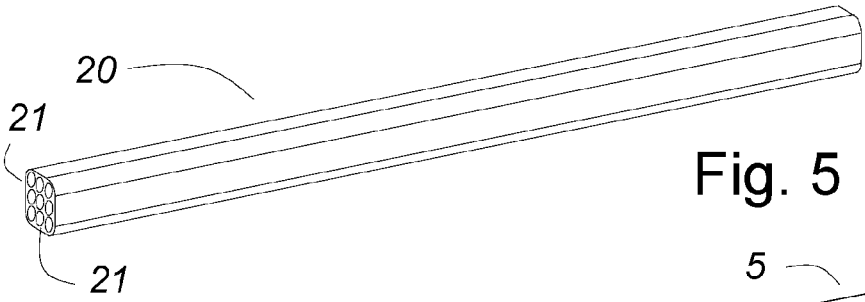
FIGS. 5 and 5*a* shows a cellular insert for a cellular transformer.
Figure 5A:
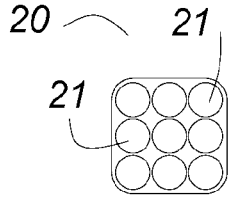

FIG. 5 shows a cellular insert 20 that may be a molded or extruded insulating material. The cellular insert 20 has through it lengthwise a plurality of holes 21—21. FIG. 5*a* shows a section of the cellular insert 20.

Figure 6:
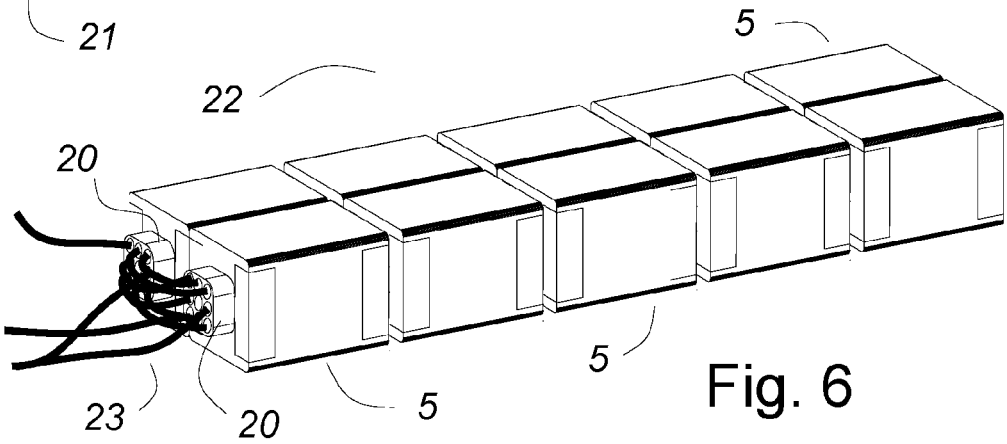
FIG. 6 shows a cellular transformer using the cellular insert of FIGS. 5 and 5*a*.

FIG. 6 shows a cellular transformer 22 comprising five elements 5—5 as an example, not a limitation. A primary winding 23 is wound through two cellular inserts 20, 20 which extend the length of the cellular transformer 22 through the through holes through the five elements 5—5. The winding shown, as an illustration, not a limitation, is a push pull winding having four turns on each half and threaded through the eight peripheral holes of the cellular inserts 20, 20. As the cellular inserts 20, 20 of this example have nine through holes 21—21, one of the through holes is unused, or may be used for another purpose.

Despite the volume that is occupied by the cellular inserts 20, 20, the winding factor of the cellular transformer 22 may be improved over the comparable matrix transformer, for example, the matrix transformer 10 of FIG. 4. This is because in the matrix transformer as the windings are threaded through the through holes of the elements, they tend to curve and cross over each other, successive wires following a random path. As more wires are added, the through hole becomes crowded, and it becomes more and more difficult to complete the winding. Further, there is no control of the placement of the wires, making the winding characteristics inconsistent.

By contrast, each turn of the cellular transformer has a specific hole through which it is threaded. It cannot bow or cross over other wires and its location is the same from transformer to transformer, yielding consistent characteristics.

In the example of FIG. 6, the cellular transformer 22 has one wire through each of the eight holes used in the cellular inserts 20, 20. More than one turn may pass through each hole if a large number of primary turns are required, though it becomes difficult if the number is too great. Certain two to four wires are no problem, but it would be extremely difficult to wind the equivalent 16 to 32 turns without the cellular inserts to guide and locate the wires. For multiple passes, a single wire may make multiple passes, or a multi-conductor wire may make a single pass and be connected appropriately after winding.

Figure 7:
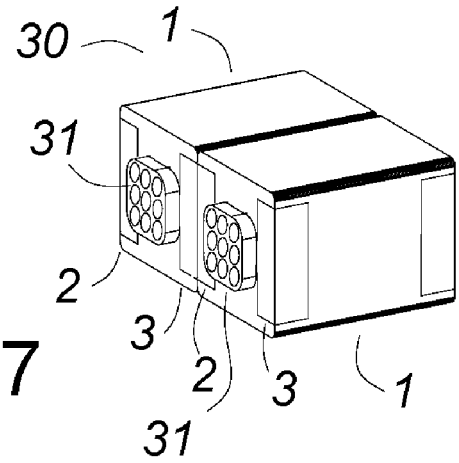
FIG. 7 shows an element of a cellular transformer in which the cellular inserts are short, just slightly longer than the magnetic cores.

FIG. 7 shows an element 30 for a cellular transformer comprising two magnetic cores 1, 1 which may be the magnetic cores 1 of FIG. 1, as an example, not a limitation. Each of the magnetic cores 1, 1 has therein two secondary windings 2 and 3 which may be the secondary windings 2 and 3 shown in FIG. 2. Cellular inserts 31, 31 are placed in the through holes of the magnetic cores 1, 1.

Figure 8:
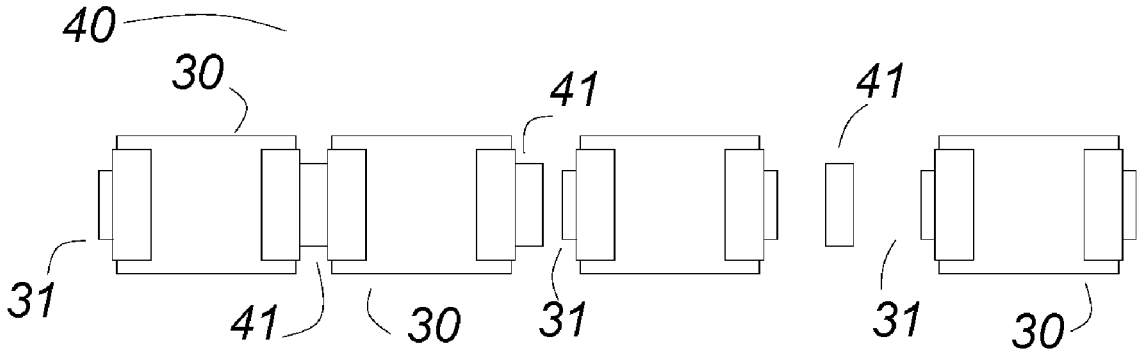
FIG. 8 shows a cellular transformer being assembled from the elements of FIG. 7 with coupling spacers.

FIG. 8 shows four of the elements 30—30 of FIG. 7 being assembled for a cellular transformer 40. Spacers 41—41 fit snuggly around the extended ends of the cellular inserts 31—31 to align them and space them apart correctly.

Figure 9:
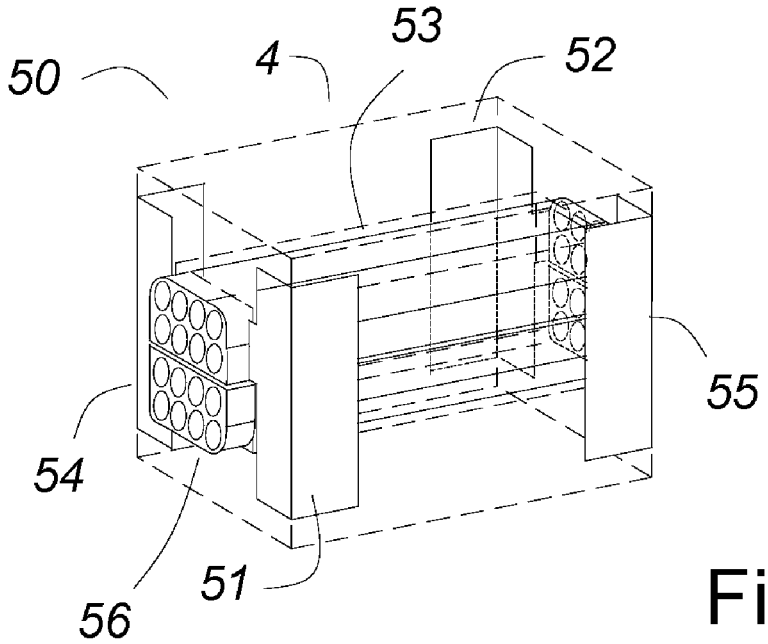
FIG. 9 shows a phantom view of an element of a cellular transformer in which the cellular inserts are conducting and comprise part of the secondary circuit.

FIG. 9 shows cellular inserts 53 and 53 which are metal and which comprise part of the secondary circuit. In the manner of FIG. 2, the cellular inserts 53 and 56 are shown in a phantom core 4. The cellular inserts must be separated from each other and the core by insulation, not shown, which could be an insulating coating or separate material. The preferred way of insulating the core and the cellular inserts is by coating the core with an insulating film and using an insulating separator 57 between the cellular inserts 53 and 56. As an illustration, not a limitation, the insulating separator 57 may be inserted between the cellular inserts 53 and 56 to urge them apart and into good contact with the magnetic core, for better thermal contact between the parts.

The first cellular insert 53 is terminated on one end by a first metal terminal 51 and on the other end by a second metal terminal 52. The first and second metal terminals 51 and 52 are diagonally opposite for the convenience of later interconnection of the transformer. If more convenient for a particular application, they could be on the same side. The second cellular insert 56 is similarly terminated by third and fourth metal terminals 54 and 55.

When used in a multi-element cellular transformer, it is preferred to use spacers such as the spacers 41—41 of FIG. 8 to locate and separate the elements and align the through holes of the cellular inserts. The cellular insert could be coated with an insulating film, but it is preferred to wind cellular transformers having metal cellular inserts with insulated wire, probably double or triple insulated wire. This winding arrangement is particularly good for high current, high frequency operation. At high frequency, surface effects such as the well known penetration depth are important considerations. The area available for conduction is the combined peripheral area of the several holes through the metal cellular insert. Each turn of the primary winding is coaxially coupled to the peripheral area of the hole through which it passes, so the coupling is very high and the leakage inductance is very low. Also, because each turn of the primary winding is surrounded by metal with a direct thermal conduction path out of the transformer, the temperature rise of the transformer is very low even with very high current densities.

Figure 10:
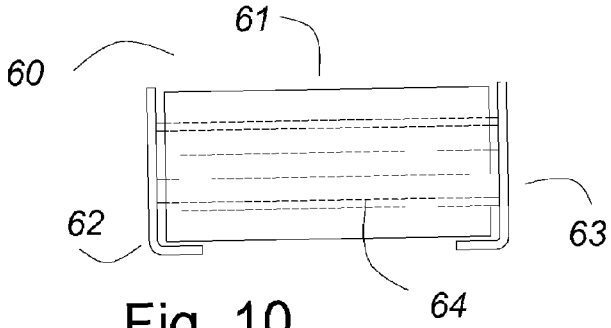
FIGS. 10 through 12 show an element for a cellular transformer having a single secondary winding, as might be used for a forward converter or ac transformer.
Figure 11:
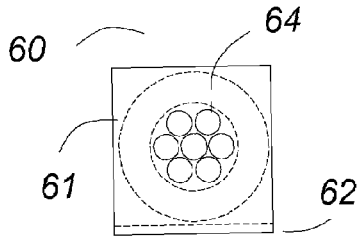
Figure 12:
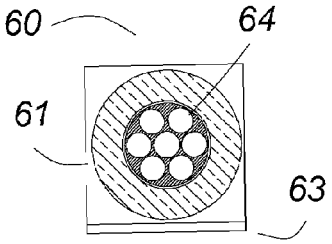

FIGS. 10 through 12 show a single winding element 60 for a cellular transformer, as might be used for a forward converter or an ac transformer. As an illustration, not a limitation, a metal cellular insert. 64 has seven through holes. It passes through a magnetic core 61 and is terminated on each end by terminals 26 and 63, shown, as an illustration, not a limitation, as surface mount terminals. For low voltage operation, it may not be necessary to insulate the cellular insert 64 from the magnetic core 61, making assembly very easy.

Figure 14:
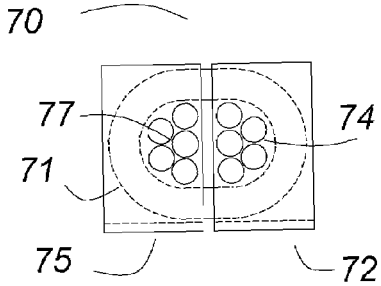
FIGS. 13 through 15 show an element for a cellular transformer having two secondary windings, as might be used for a push pull full wave rectified circuit.
Figure 15:
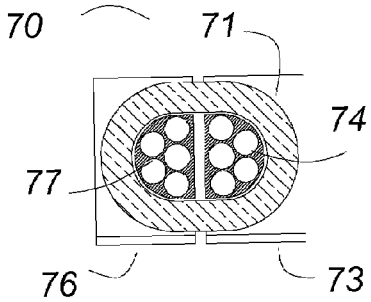
Figure 13:
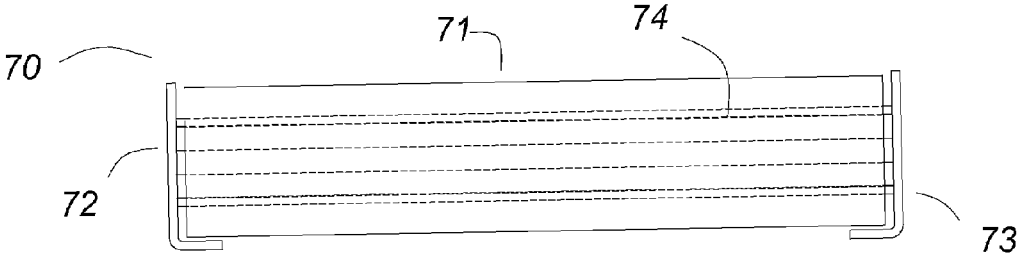

FIGS. 13 through 15 show a similarly constructed winding element 70 with two metal cellular inserts 74 and 77 within a magnetic core 71. Each of the metal cellular inserts 74 and 77 has five through holes, as an illustration, not a limitation, and they are terminated respectively with surface mount feet 72, 73 and 74, 75.

Figure 16:
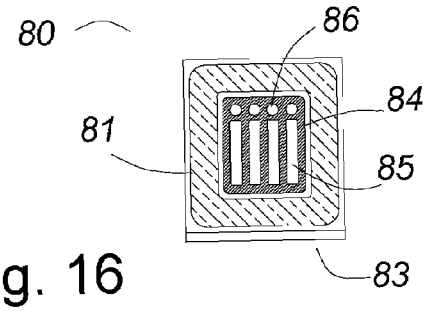
FIG. 16 shows a section of an element of a cellular transformer where the primary winding may be four flat conductors and a separate reset winding may be used.

FIG. 16 shows a section of a element 80 comprising a metal cellular insert 84 inside a magnetic core 81. One termination 83 can be seen, and the cellular insert has four rectangular holes 85—85 for a high current primary conductor. A wide flat conductor has more surface area to improve the conduction in light of the penetration depth. Smaller through holes 86—86 may be used for a separate reset winding, as an example, not a limitation.

Figure 17:
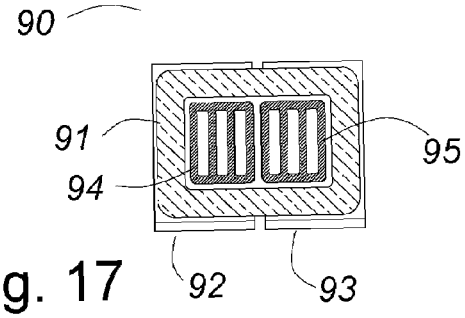
FIG. 17 shows a section of an element of a cellular transformer where the primary winding may be a four turn push pull winding.
Figure 18:
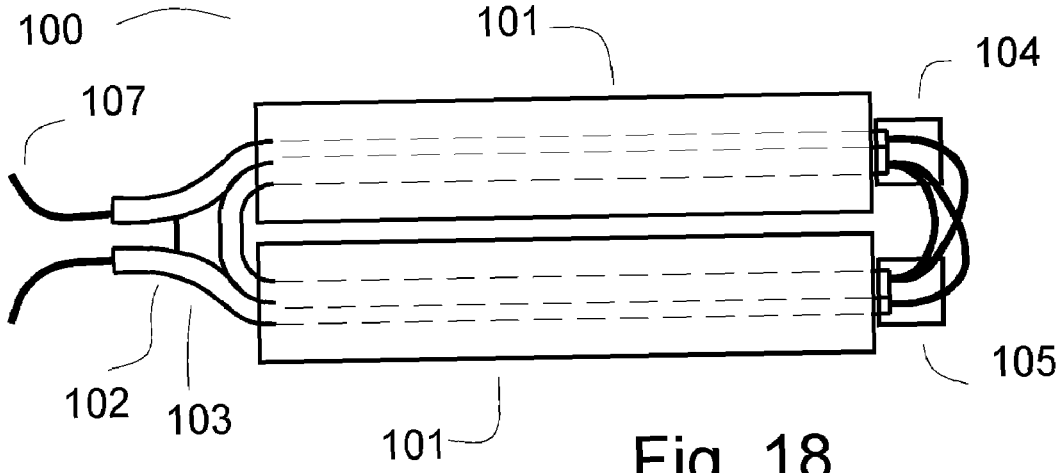
FIGS. 18 through 21 show a cellular transformer where the cellular insert is a bundle of formed metal tubes.
Figure 19:
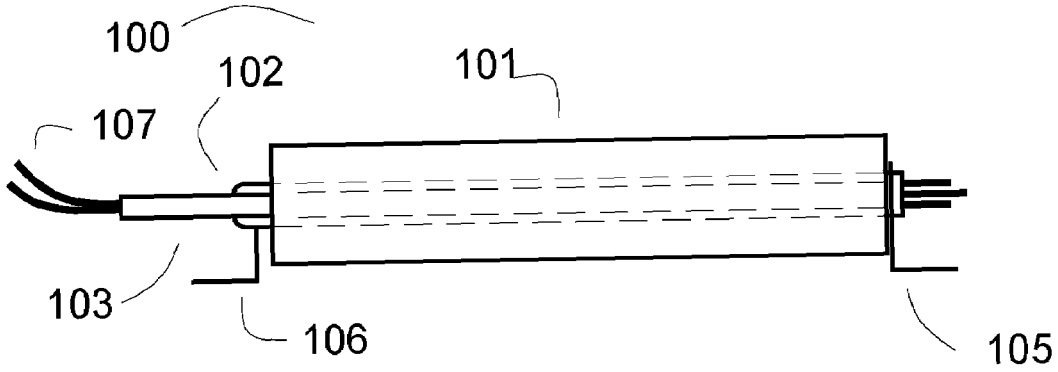
Figure 20:
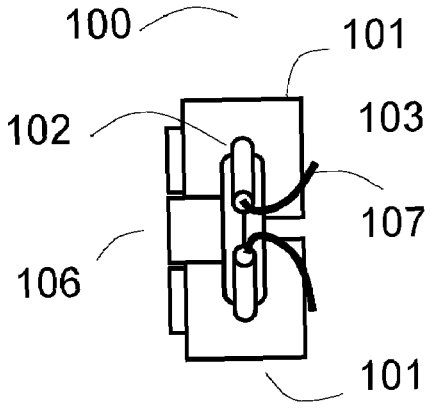
Figure 21:
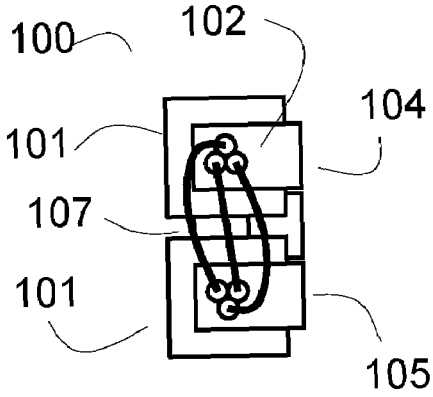

FIG. 17 shows a section of a similarly constructed element 90 comprising two metal cellular inserts 94 and 95 in a magnetic core 91. Two of the terminations 92 and 93 are shown.

FIGS. 18 through 21 show a cellular transformer 100 comprising two magnetic cores 101, 101 and a cellular secondary winding 102 comprising formed metal tubing 103. The cellular secondary winding is terminated by terminals 104 and 105, shown, as an example, not a limitation, as surface mount terminals. A mounting foot 106 would not usually be used as an electrical terminal for the cellular transformer 100 due to ampere-turn limitations in the magnetic cores 101, 101, however it can support the transformer and provide heat sinking. It can also be used as a safety ground terminal for the cellular secondary winding. A primary winding 107 is threaded through the cellular secondary winding 102. With reference to U.S. Pat. No. 6,137,392 "Transformer for Switched Mode Power Supplies and Similar Applications", this cellular transformer design would be suitable as a first stage module for a transformer having very high dielectric isolation as taught therein.

In the several figures of this specification, magnetic cores with a single hole in them have been shown. This is usually preferred, but the teachings of this invention apply as well to magnetic cores having two or more holes. Usually it is advantageous to use a gap-less magnetic core, so these have been shown as an illustration, not a limitation. The teachings of this invention would apply to two part cores as well. In the several figures of this specification, the secondary winding is shown as a single turn secondary winding, or a single turn push-pull (two turn, center-tapped or split) winding. The teachings of this invention would apply to transformer having multiple turn secondaries as well, in particular, it would apply to the four turn matrix transformer module of U.S. patent application Ser. No. 10/025,138 filed Dec. 19, 2001, 'Module for Matrix Transformers Having a Four Turn Secondary Winding'.

Transformers being reciprocal devices, the recitation of primary and secondary is arbitrary, and the nomenclature is customarily reversed if a transformer used in reverse. Therefore, in this specification and the claims, the terms "primary" and "secondary" each include the other for a transformer connected in reverse.

What is claimed is:

1. A cellular transformer comprising at least a first magnetic core having at least a first through hole therein for receiving at least a first secondary winding having at least a first secondary turn and a primary winding having a plurality of primary turns, the at least a first secondary winding passing at least once through the at least a first through hole of the at least a first magnetic core so that a changing magnetic flux in the at least a first magnetic core may induce a secondary voltage therein, at least a first cellular insert passing through the at least a first through hole of the at least a first magnetic core having therein a plurality of through holes generally parallel to the at least a first through hole of the at least a first magnetic core for receiving the primary winding, and the primary winding being wound through the at least a first cellular insert and through the at least a first through hole of the at least a first magnetic core to induce a changing magnetic flux therein, such that the plurality of primary turns is distributed generally equally among the plurality of through holes in the at least a first cellular insert and the plurality of through holes in the at least a first cellular insert guides and supports the plurality of turns of the primary winding.

2. The cellular transformer of claim 1 wherein the at least a first cellular insert is made of an insulating material.

3. The cellular transformer of claim 1 wherein the at least a first cellular inserts is continuous through the length of the cellular transformer.

4. The cellular transformer of claim 1 wherein the at least a first cellular insert is generally the length of the at least a first magnetic core.

5. The cellular transformer of claim 1 wherein the at least a first cellular insert is at least a first metal cellular insert and the at least a first metal cellular insert comprises a portion of the at least a first secondary winding.

6. The cellular transformer of claim 1 wherein the at least a first cellular insert is formed of metal tubing.

* * * * *